US009082361B2

(12) United States Patent
Ye et al.

(10) Patent No.: US 9,082,361 B2
(45) Date of Patent: Jul. 14, 2015

(54) POLARIZED THREE-DIMENSIONAL DISPLAY PANEL AND PIXEL CELL THEREOF

(71) Applicant: SHENZHEN CHINA STAR OPTOELECTRONICS TECHNOLOGY CO., LTD., Shenzhen, Guangdong (CN)

(72) Inventors: Chengliang Ye, Shenzhen (CN); Deyong Fan, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/241,424

(22) PCT Filed: Jan. 17, 2014

(86) PCT No.: PCT/CN2014/070773

§ 371 (c)(1),
(2) Date: Feb. 26, 2014

(87) PCT Pub. No.: WO2015/051601

PCT Pub. Date: Apr. 16, 2015

(65) Prior Publication Data

US 2015/0103063 A1 Apr. 16, 2015

(51) Int. Cl.
*G09G 3/36* (2006.01)

(52) U.S. Cl.
CPC ..... *G09G 3/3648* (2013.01); *G09G 3/3677* (2013.01); *G09G 3/3688* (2013.01); *G09G2300/0426* (2013.01); *G09G 2310/0202* (2013.01); *G09G 2310/0278* (2013.01); *G09G 2320/0209* (2013.01)

(58) Field of Classification Search
CPC . G09G 3/3648; G09G 3/3688; G09G 3/3677; G09G 2320/0209; G09G 2300/0426; G09G 2310/0278; G02B 27/20
See application file for complete search history.

(56) References Cited

U.S. PATENT DOCUMENTS 8,773,517 B2 * 7/2014 Niioka et al. ..... 348/54
8,982,302 B2 * 3/2015 Kim et al. ..... 349/110

FOREIGN PATENT DOCUMENTS

CN 101216645 A 7/2008
CN 102713747 A 10/2012
CN 102879960 A 1/2013
CN 103246094 A 8/2013

* cited by examiner

*Primary Examiner* — Abbas Abdulselam
(74) *Attorney, Agent, or Firm* — Stein IP, LLC

(57) ABSTRACT

The present disclosure discloses a polarized three-dimensional display panel and a pixel cell thereof. The display panel comprises an array substrate, which includes a plurality of pixel cells arranged in a plurality of pixel zones configured by a plurality of scanning lines and a plurality of data lines arranged in a staggered manner. Each pixel cell comprises a primary pixel electrode configured to receive a scanning signal of a first scanning line, and further to receive a data signal in a data line, so as to have a primary zone voltage; a secondary pixel electrode configured to receive the scanning signal of the first scanning line, and further to receive the data signal in the data line, so as to have a secondary zone voltage; and a charge-sharing unit configured to receive a scanning signal of a second scanning line, so as to allow a voltage difference between the secondary zone voltage and the primary zone voltage, wherein the primary pixel electrode and the secondary pixel electrode are disturbed in a left-right manner. The present disclosure can effectively solve the problem of inconsistent degrees of binocular signal crosstalk in viewing a polarized three-dimensional display from a top view and a bottom view.

19 Claims, 4 Drawing Sheets

POLARIZED THREE-DIMENSIONAL DISPLAY PANEL AND PIXEL CELL THEREOF

FIELD OF THE INVENTION

The present disclosure relates to a three-dimensional image display technology, particularly to a polarized three-dimensional display panel and a pixel cell thereof.

BACKGROUND OF THE INVENTION

Film Patterned Retarder (referred to as FPR), also known as a polarized three-dimensional display panel, is one of the mainstream products in the current three-dimensional display market. An FPR three-dimensional display panel comprises an array substrate and a color filter substrate. One side of the color filter substrate far away from the array substrate is provided with a phase retardation film, which is used to divide the three-dimensional display image into left and right eye images by cooperating with polarized glasses. The left and right eye images are then transferred to the viewer's left and right eyes, respectively. Subsequently, the viewer's brain will fuse the left and right eye images into a stereoscopic image accompanied with depth information, so that the three-dimensional display function is achieved. Specifically, the phase retardation film can be partitioned in accordance with the pixel row, with two adjacent rows being 45° and 135° quarter-wave plates respectively, so that the even-row pixel cells and the odd-row pixel cells will display circularly polarized lights in the opposite directions, thus achieving the purpose of separating the left and right eye images.

Meanwhile, in order to solve the problem of large viewing angle color shift, the array substrate of the polarized three-dimensional display panel generally adopts the pixel cell structure as shown in FIG. 1 in recent years. With respect to the pixel cell as shown in FIG. 1, the pixel electrode is divided into a primary pixel electrode zone I and a secondary pixel electrode zone II in an upper and lower distribution manner. The primary pixel electrode zone I comprises a thin film transistor T1, with its grid electrode connected to a first scanning line GLm, and its source electrode connected to a data line DLn. In addition, a liquid crystal capacitor Clc1 and a storage capacitor Cst1 are connected in parallel between the drain electrode of the thin film transistor T1 and the common electrode Com. The secondary pixel electrode zone II comprises a thin film transistor T2, with its grid electrode connected to the first scanning line GLm, and its source electrode connected to the data line DLn. In addition, a liquid crystal capacitor Clc2 and a storage capacitor Cst2 are connected in parallel between the drain electrode of the thin film transistor T2 and the common electrode Com. Moreover, the grid electrode of a thin film transistor T3 is connected to a second scanning line GLm+1, and a charge-shared capacitor Ccs is connected between the source electrode of the thin film transistor T3 and the common electrode Com. In case a scanning signal exists on the second scanning line GLm+1, the thin film transistor T3 will feed through the secondary pixel electrode zone II and charge-shared capacitor Ccs, thereby reducing the voltage of the secondary pixel electrode zone II (as FIG. 1 is a top view, the capacitors have not been marked therein). By virtue of this charge-sharing technology, the primary pixel electrode zone I and the secondary pixel electrode zone II are featured by different voltage values, thereby controlling the respective corresponding liquid crystals to deflect according to different deflection angles in order to achieve the purpose of large viewing angle color shift compensation.

Besides the aforementioned color shift problem, when the viewer watches a three-dimensional image in a larger viewing angle, the cross-talk problem of left and right eye images will also be encountered. For example, the left-eye image that is originally designated to transmit to the left eye is observed by the right eye also, thereby resulting in the binocular signal crosstalk and affecting three-dimensional imaging effects. Moreover, when the primary pixel electrode and the secondary pixel electrode of the pixel cell are vertically distributed, the degree of binocular signal crosstalk is varied if the viewer watches the three-dimensional image from a top view and a bottom view. Typically, the voltage of the secondary pixel electrode is lower than that of the primary pixel electrode, and thus the display brightness in the pixel cell secondary zone will be lower than that of the primary zone accordingly. When the viewer watches in a top view, the great majority of lights is received from the pixel cell primary zone, characterized by high brightness; in contrast, when the viewer watches in a bottom view, the great majority of lights is received from the pixel cell secondary zone, characterized by low brightness, thereby causing severer degree of binocular signal crosstalk for the former manner in comparison to the later one, and resulting in inconsistent degree of binocular signal crosstalk.

SUMMARY OF THE INVENTION

With respect to above-mentioned problems, the objective of the present disclosure is to provide a polarized three-dimensional display panel and its pixel cell, characterized by identical degree of binocular signal crosstalk when the viewer watches this display panel in a top view and a bottom view.

The present disclosure provides a pixel cell used in a polarized three-dimensional display panel, comprising:

a primary pixel electrode configured to receive a scanning signal of a first scanning line, and further to receive a data signal in a data line, so as to have a primary zone voltage;

a secondary pixel electrode configured to receive the scanning signal of the first scanning line, and further to receive the data signal in the data line, so as to have a secondary zone voltage; and a charge-sharing unit configured to receive a scanning signal of a second scanning line, and further to share charges in the secondary pixel electrode, so that the secondary zone voltage of the secondary pixel electrode is different from the primary zone voltage of the primary pixel electrode;

wherein the primary pixel electrode and the secondary pixel electrode are distributed in a left-right manner.

Further, with regard to the aforementioned pixel cell, the area of the primary pixel electrode is smaller than that of the secondary pixel electrode.

Preferably, the area ratio between the primary pixel electrode and the secondary pixel electrode as described is 4:6.

In one embodiment according to the present disclosure, the pixel cell as described above further comprises:

a first switching element, with its control terminal connected to the first scanning line, its first electrode connected to the data line, and its second electrode connected to the primary pixel electrode.

In one embodiment according to the present disclosure, the pixel cell as described above further comprises:

a second switching element, with its control terminal connected to the first scanning line, its first electrode connected to the data line, and its second electrode connected to the secondary pixel electrode.

In one embodiment according to the present disclosure, the charge-sharing unit of the pixel cell as described above comprises a third switching element and a charge-sharing capacitor, the third switching element with its control terminal connected to the second scanning line, its first electrode connected to the secondary pixel electrode, and its second electrode coupled with the charge-sharing capacitor.

In one embodiment according to the present disclosure, an upper electrode of the charge-sharing capacitor as described above is connected to the second electrode of the third switching element.

In one embodiment according to the present disclosure, a lower electrode of the charge-sharing capacitor as described is one part of a common electrode line.

In one embodiment according to the present disclosure, the common electrode line and the scanning line as described are formed by one single photomask.

In addition, the present disclosure also provides a polarized three-dimensional display panel, comprising an array substrate, which is provided with the pixel cells as described above.

Compared with the prior art, the present disclosure has the following advantages. According to the present disclosure, by changing the distribution structure of the pixel electrodes of pixel cell in the polarized three-dimensional display panel, the primary pixel electrode and secondary pixel electrode can be arranged in a left-right manner, so that the degree of binocular signal crosstalk is identical when the viewer watches the polarized three-dimensional display panel in a top view and a bottom view.

Other features and advantages of the present disclosure will be set forth in the description which follows, and in part will be obvious in the description, or be learned by implementing of the present disclosure. The objectives and other advantages of the present disclosure may be realized and attained by structures particularly pointed out in the description, claims and accompanying drawings.

BRIEF DESCRIPTION OF THE DRAWINGS

The following drawings are presented for the purpose of further understanding of the present disclosure and constitute one integral part of this description, as well as for the purpose of better understanding of the present disclosure in combination with the embodiments, rather than limitation of the present disclosure, wherein.

DETAILED DESCRIPTION OF THE EMBODIMENTS

To more clearly demonstrate the objectives, technical solutions, and advantages of the present disclosure, the present disclosure will be described in further detail in combination with the specific embodiments and accompanying drawings.

Figure 1:
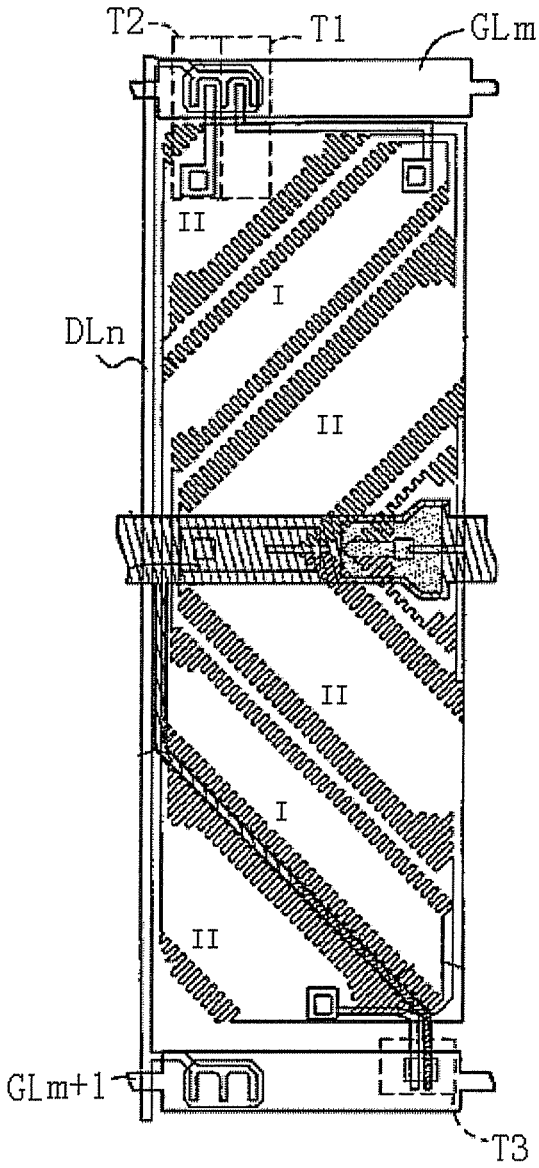
FIG. 1 is a schematic diagram of a pixel electrode for a pixel cell of a polarized three-dimensional display panel in the prior art.
Figure 2:
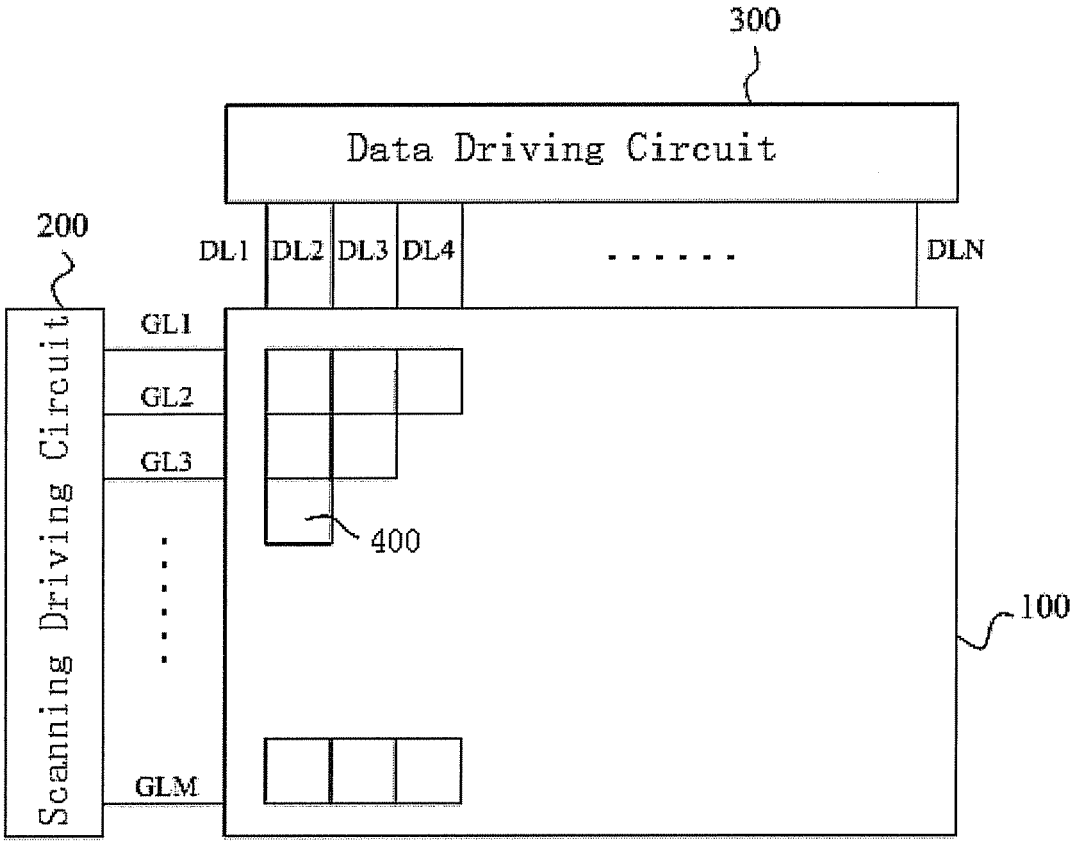
FIG. 2 is a schematic diagram of an array substrate for a polarized three-dimensional display panel as described in one embodiment of the present disclosure.

FIG. 2 is a schematic diagram of an array substrate 100 in accordance with one embodiment of the present disclosure. The array substrate 100 comprises a plurality of scanning lines (GL1~GLM) connected to a scanning driving circuit 200, a plurality of data lines (DL1~DLN) connected to a data driving circuit 300, and a plurality of pixel cells 400. The plurality of pixel cells 400 are arranged in a plurality of pixel cell zones 500 configured by the plurality of scanning lines (GL1~GLM) and the plurality of data lines (DL1~DLN) arranged in a staggered manner. Specifically, each pixel cell 400 is connected to one data line, one first scanning line, and one second scanning line.

Figure 3:
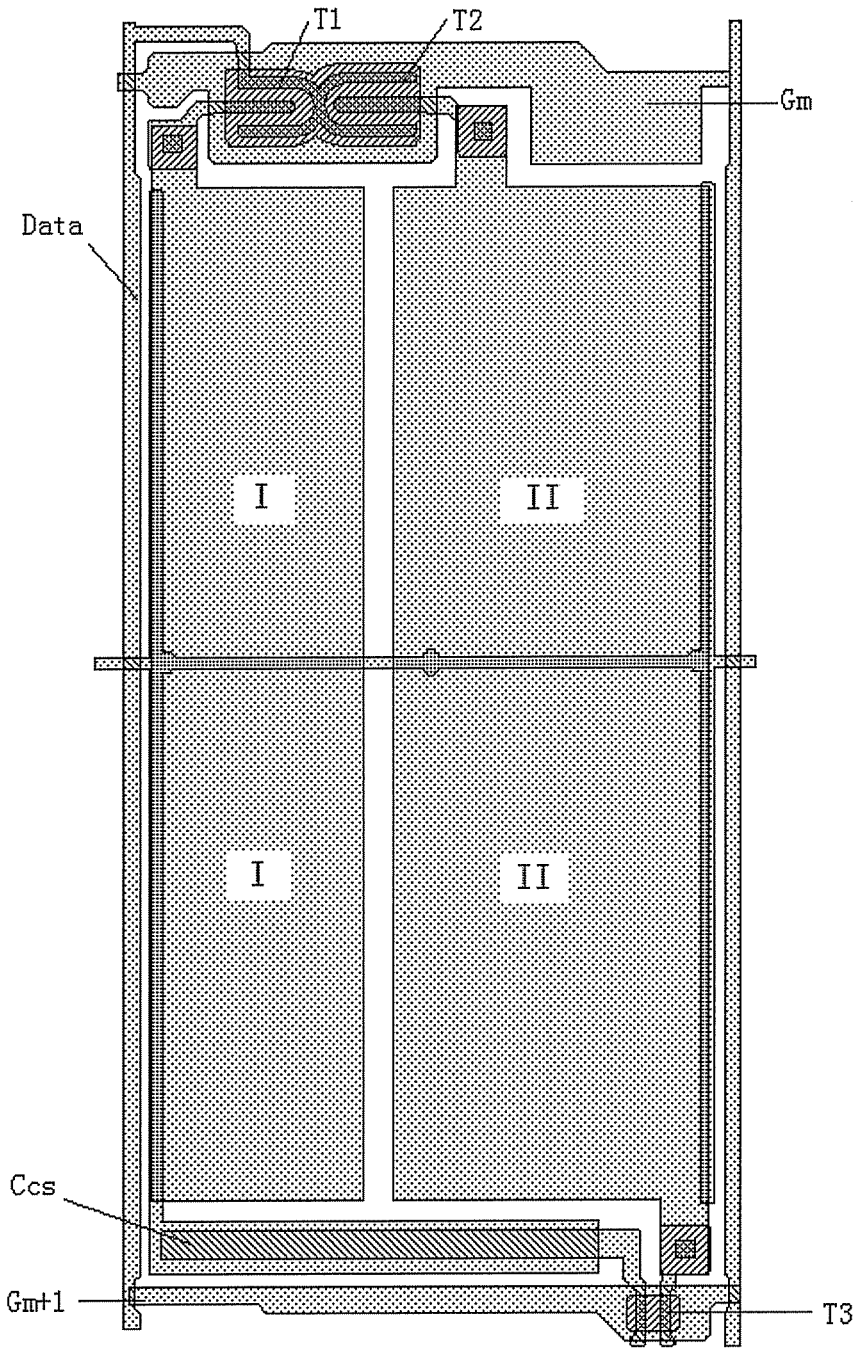
FIG. 3 is a schematic diagram of a pixel cell for the polarized three-dimensional display panel as described in one embodiment of the present disclosure.

FIG. 3 is a schematic diagram of one pixel cell according to one embodiment proposed in the present disclosure. The pixel cell is arranged in the pixel zone as shown in FIG. 3, which comprises:

a primary pixel electrode zone I, configured to receive a scanning signal Gm of a first scanning line, and to receive a data signal Data in a data line under the effect of the scanning signal Gm, so as to have a primary zone voltage V_I;

a secondary pixel electrode zone II, configured to receive the scanning signal Gm of the first scanning line, and to receive the data signal Data in the data line under the effect of the scanning signal Gm, so as to have a primary zone voltage V_II; and a charge-sharing unit, configured to receive a scanning signal Gm+1 of the second scanning line and further to share charges on the secondary pixel electrode zone II, whereby a voltage difference is caused between the secondary zone voltage V_II of the secondary pixel electrode zone II and the primary zone voltage V_I of the primary pixel electrode zone I, so that the display panel is able to achieve a preferred low color shift effect.

In comparison to the pixel cells on the array substrate of a conventional polarized three-dimensional display panel, the primary pixel electrode zone I and the secondary pixel electrode zone II of the pixel cells on the array substrate in the present disclosure are distributed in a left-right manner, so that the degree of binocular signal crosstalk is identical when the viewer watches the display panel in a top view and a bottom view.

Figure 4:
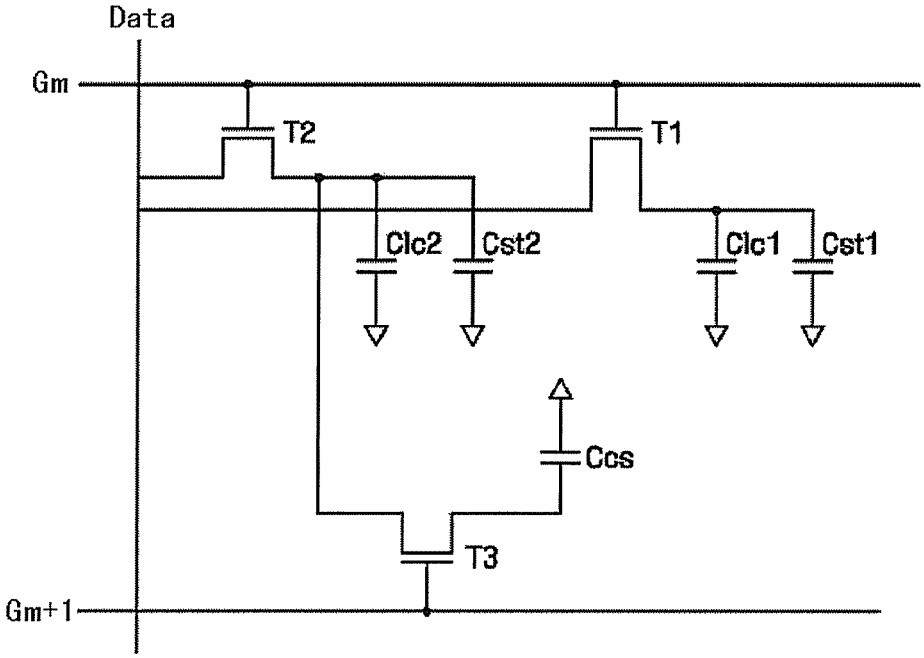
FIG. 4 is an equivalent circuit diagram of the pixel cell as described in FIG. 3.

FIG. 4 is an equivalent circuit schematic diagram of a particular embodiment for a pixel cell.

With respect to the primary pixel electrode zone I as shown in FIG. 4, the pixel cell further comprises a first switching element T1, a first liquid crystal capacitor Clc1, and a first storage capacitor Cst1. Regarding the first switching element T1, a control terminal thereof is connected to the first scanning line to receive the scanning signal Gm; a first electrode thereof is connected to the data line; and a second electrode thereof is connected to the primary pixel electrode zone. Meanwhile, a first electrode of the first crystal capacitor Clc1 and a first electrode of the first storage capacitor Cst1 are coupled with the primary pixel electrode zone I, while a second electrode of the first crystal capacitor Clc1 and a second electrode of the first storage capacitor Cst1 are preferably coupled with a common electrode Com of the array substrate. Under the action of the scanning signal Gm, the first switching element T1 is turned on, whereby the data signal Data in the data line will be transmitted to the first liquid crystal capacitor Clc1 and the first storage capacitor Cst1 via the first switching element T1. The first liquid crystal capacitor Clc1 and the first storage capacitor Cst1 will be charged according to the data signal Data and thus have the corresponding voltage potentials. On this basis, the primary pixel electrode zone I has the corresponding primary zone I voltage V_I, so that the liquid crystals corresponding to the primary pixel electrode zone I are subjected to deflection in order to display the corresponding image data.

With respect to the secondary pixel electrode zone II as shown in FIG. 4, the pixel cell further comprises a second switching element T2, a second liquid crystal capacitor Clc2, and a second storage capacitor Cst2. Regarding the second switching element T2, a control terminal thereof is connected to the first scanning line to receive the scanning signal Gm; a first electrode thereof is connected to the data line; and a second electrode thereof is connected to the secondary pixel electrode zone II. Meanwhile, a first electrode of the second crystal capacitor Clc2 and a first electrode of the second storage capacitor Cst2 are coupled with the secondary pixel electrode zone II, while a second electrode of the second crystal capacitor Clc2 and a second electrode of the second storage capacitor Cst2 are preferably coupled with the common electrode Com of the array substrate. Under the action of the scanning signal Gm, the second switching element T2 is turned on, whereby the data signal Data in the data line will be transmitted to the second liquid crystal capacitor Clc2 and the second storage capacitor Cst2 via the second switching element T2. The second liquid crystal capacitor Clc2 and the second storage capacitor Cst2 will be charged according to the data signal Data and thus have corresponding voltage potentials. On this basis, the secondary pixel electrode zone II has a corresponding secondary zone II voltage V_II, so that the liquid crystals corresponding to the secondary pixel electrode zone II are subject to deflection in order to display the corresponding image data.

With respect to the charge-sharing unit as shown in FIG. 4, this embodiment preferably adopts a third switching element T3 and a charge-sharing capacitor Ccs, but is absolutely not limited thereto. Regarding the third switching element T3, a control terminal thereof is connected to the second scanning line Gm+1 to receive the scanning signal Gm+1; a first electrode thereof is connected to the secondary pixel electrode zone II; and a second electrode thereof is coupled with an upper electrode of the charge-sharing capacitor Ccs, a lower electrode of which preferably constitutes one integral part of the common electrode Com line of the array substrate. The common electrode Com line of the array substrate can be constituted by a same photomask with the scanning line. Under the action of the scanning signal Gm+1, the third switching element T3 is turned on, whereby the charges on the secondary pixel electrode zone II will be transmitted to the charge-sharing capacitor Ccs via the third switching element T3, thus resulting changes in the voltage potential of the secondary pixel electrode zone II, namely, the secondary zone voltage V_II. Therefore, a voltage difference is caused between the primary zone voltage V_I and the secondary zone voltage V_II, so that the display panel is able to achieve a preferred low color shift effect.

Preferably, the aforementioned switching elements are made of thin film transistors. The control terminals are grid electrodes, the first electrodes and the second electrodes may be drain electrodes and source electrodes respectively, which are set in accordance with the direction of current flow specifically, and will not be limited herein.

When the aforementioned primary pixel electrode and secondary pixel electrode are distributed in the left-right manner, for the viewer, the received light is the result of the interaction between the light emitted from the primary zone and the light emitted from the secondary zone, no matter the three-dimensional display panel is viewed from the top view or from the bottom view. Therefore, the degree of binocular signal crosstalk is identical with regard to the aforementioned two viewing angles, thereby improving the original problem of asymmetry of binocular signal crosstalk.

Preferably, the area of the primary pixel electrode is smaller than that of the secondary pixel electrode. With regard to the pixel cells of the conventional three-dimensional display array substrate, the area ratio between the primary pixel electrode and the secondary pixel electrode is 4:6 in general. The pixel cells of the display panel array substrate provided in the present disclosure can also be set according to the same ratio as 4:6 between the primary pixel electrode and the secondary pixel electrode. However, as the primary pixel electrode and the secondary pixel electrode are distributed in the left-right manner, the spacing area between the primary pixel electrode and the secondary pixel electrode will be increased accordingly, and thus its aperture ratio is lower than that of a conventional three-dimensional display panel. Of course, it can be optimized by adjusting the specific sizes, which is not detailed herein.

In another aspect, the present disclosure also provides one embodiment of a polarized three-dimensional display panel, comprising an array substrate, which is provided with the pixel cells as described above.

The driving method of the polarized three-dimensional display panel proposed in the present disclosure is identical with that of a conventional one, and therefore will no longer be repeatedly described herein.

Apparently, the afore-mentioned embodiments are presented for the purpose of better illustrating the present disclosure, rather than limitation of this disclosure. For one ordinarily skilled in the art changes or modifications may be made on the basis of the above-described illustration in different forms, and any obvious changes or modifications derived from the technical program of this disclosure fall within the scope of the present disclosure. Accordingly, the protection scope of the present disclosure should be subjected to the scope of protection as described in the following claims.

The invention claimed is:

1. A pixel cell used in a polarized three-dimensional display panel, comprising:

a primary pixel electrode configured to receive a scanning signal of a first scanning line, and further to receive a data signal in a data line, so as to have a primary zone voltage;

a secondary pixel electrode configured to receive the scanning signal of the first scanning line, and further to receive the data signal in the data line, so as to have a secondary zone voltage; and a charge-sharing unit configured to receive a scanning signal of a second scanning line, and further to share charges in the secondary pixel electrode, so that the secondary zone voltage of the secondary pixel electrode is different from the primary zone voltage of the primary pixel electrode;

wherein the primary pixel electrode and the secondary pixel electrode are distributed in a left-right manner.

2. The pixel cell according to claim 1, wherein the area of the primary pixel electrode is smaller than that of the secondary pixel electrode.

3. The pixel cell according to claim 2, wherein the area ratio between the primary pixel electrode and the secondary pixel electrode is 4:6.

4. The pixel cell according to claim 3, further comprising:

a second switching element, with its control terminal connected to the first scanning line, its first electrode connected to the data line, and its second electrode connected to the secondary pixel electrode.

5. The pixel cell according to claim 2, further comprising:

a first switching element, with its control terminal connected to the first scanning line, its first electrode connected to the data line, and its second electrode connected to the primary pixel electrode.

6. The pixel cell according to claim 5, wherein said charge-sharing unit comprises a third switching element and a charge-sharing capacitor, the third switching element with its control terminal connected to the second scanning line, its first electrode connected to the secondary pixel electrode, and its second electrode coupled with the charge-sharing capacitor.

7. The pixel cell according to claim 2, wherein said charge-sharing unit comprises a third switching element and a charge-sharing capacitor, the third switching element with its control terminal connected to the second scanning line, its first electrode connected to the secondary pixel electrode, and its second electrode coupled with the charge-sharing capacitor.

8. The pixel cell according to claim 2, further comprising:

a second switching element, with its control terminal connected to the first scanning line, its first electrode connected to the data line, and its second electrode connected to the secondary pixel electrode.

9. The pixel cell according to claim 1, further comprising:

a first switching element, with its control terminal connected to the first scanning line, its first electrode connected to the data line, and its second electrode connected to the primary pixel electrode.

10. The pixel cell according to claim 9, further comprising:

a second switching element, with its control terminal connected to the first scanning line, its first electrode connected to the data line, and its second electrode connected to the secondary pixel electrode.

11. The pixel cell according to claim 9, wherein said charge-sharing unit comprises a third switching element and a charge-sharing capacitor, the third switching element with its control terminal connected to the second scanning line, its first electrode connected to the secondary pixel electrode, and its second electrode coupled with the charge-sharing capacitor.

12. The pixel cell according to claim 1, further comprising:

a second switching element, with its control terminal connected to the first scanning line, its first electrode connected to the data line, and its second electrode connected to the secondary pixel electrode.

13. The pixel cell according to claim 1, wherein said charge-sharing unit comprises a third switching element and a charge-sharing capacitor, the third switching element with its control terminal connected to the second scanning line, its first electrode connected to the secondary pixel electrode, and its second electrode coupled with the charge-sharing capacitor.

14. The pixel cell according to claim 13, wherein an upper electrode of the charge-sharing capacitor is connected to the second electrode of the third switching element.

15. The pixel cell according to claim 13, wherein a lower electrode of the charge-sharing capacitor is one part of a common electrode line.

16. The pixel cell according to claim 15, wherein the common electrode line and the scanning line are formed through one single photomask.

17. A polarized three-dimensional display panel comprising an array substrate, which is provided with a pixel cell, comprising:

a primary pixel electrode configured to receive a scanning signal of a first scanning line, and further to receive a data signal in a data line, so as to have a primary zone voltage;

a secondary pixel electrode configured to receive the scanning signal of the first scanning line, and further to receive the data signal in the data line, so as to have a secondary zone voltage; and a charge-sharing unit configured to receive a scanning signal of a second scanning line, and further to share charges in the secondary pixel electrode, so that the secondary zone voltage of the secondary pixel electrode is different from the primary zone voltage of the primary pixel electrode;

wherein the primary pixel electrode and the secondary pixel electrode are disturbed in a left-right manner.

18. The polarized three-dimensional display panel according to claim 17, wherein the area of the primary pixel electrode is smaller than that of the secondary pixel electrode.

19. The polarized three-dimensional display panel according to claim 18, wherein the area ratio between the primary pixel electrode and the secondary pixel electrode is 4:6.

* * * * *